United States Patent [19]

Bowrey et al.

[11] 4,386,471

[45] Jun. 7, 1983

[54] IN-STORE DRYING CONTROL METHOD AND SYTEM

[75] Inventors: Ronald G. Bowrey, Yowie Bay; Andrew K. Fullford; Michael S. Kearney, both of Randwick, Australia

[73] Assignee: Unisearch Limited, Kensington, Australia

[21] Appl. No.: 252,135

[22] Filed: Apr. 8, 1981

[30] Foreign Application Priority Data

Apr. 8, 1980 [AU] Australia ..... PE3052

[51] Int. Cl.[3] ..... F26B 21/08; F26B 21/10

[52] U.S. Cl. ..... 34/26; 34/46; 34/48; 34/54

[58] Field of Search ..... 34/46, 48, 54, 26, 32, 34/30; 98/55

[56] References Cited

U.S. PATENT DOCUMENTS 2,935,009 5/1960 Cloud et al. ..... 34/54
3,563,460 2/1971 Nine ..... 34/54
4,053,991 10/1977 Steffen ..... 34/54

FOREIGN PATENT DOCUMENTS 48856 12/1979 Australia .

OTHER PUBLICATIONS

Control and Monitoring Panels for Grain Aeration Systems, by W. B. Edler. Jun. 1967.
Wet-Bulb Control of Grain Aeration Systems, by H. J. Griffiths New Aeration Techniques for the Preservation of Stored Cereals W. B. Elder, 1967.
Sorption Isotherms for Two Cultivars of Paddy Rice Grown in Australia, R. Putranon, R. B. Bowrey, J. Eccleston, 12/79.

*Primary Examiner*—Larry I. Schwartz
*Attorney, Agent, or Firm*—Michael J. Striker

[57] ABSTRACT

Method and means for controlling the drying and/or aeration of a stored product, particularly grains and other agricultural produce. The system requires consideration of the drying effect of blowing ambient air through the grain and is not predicated solely upon whether the ambient air will have a cooling effect on the grain.

8 Claims, 1 Drawing Figure

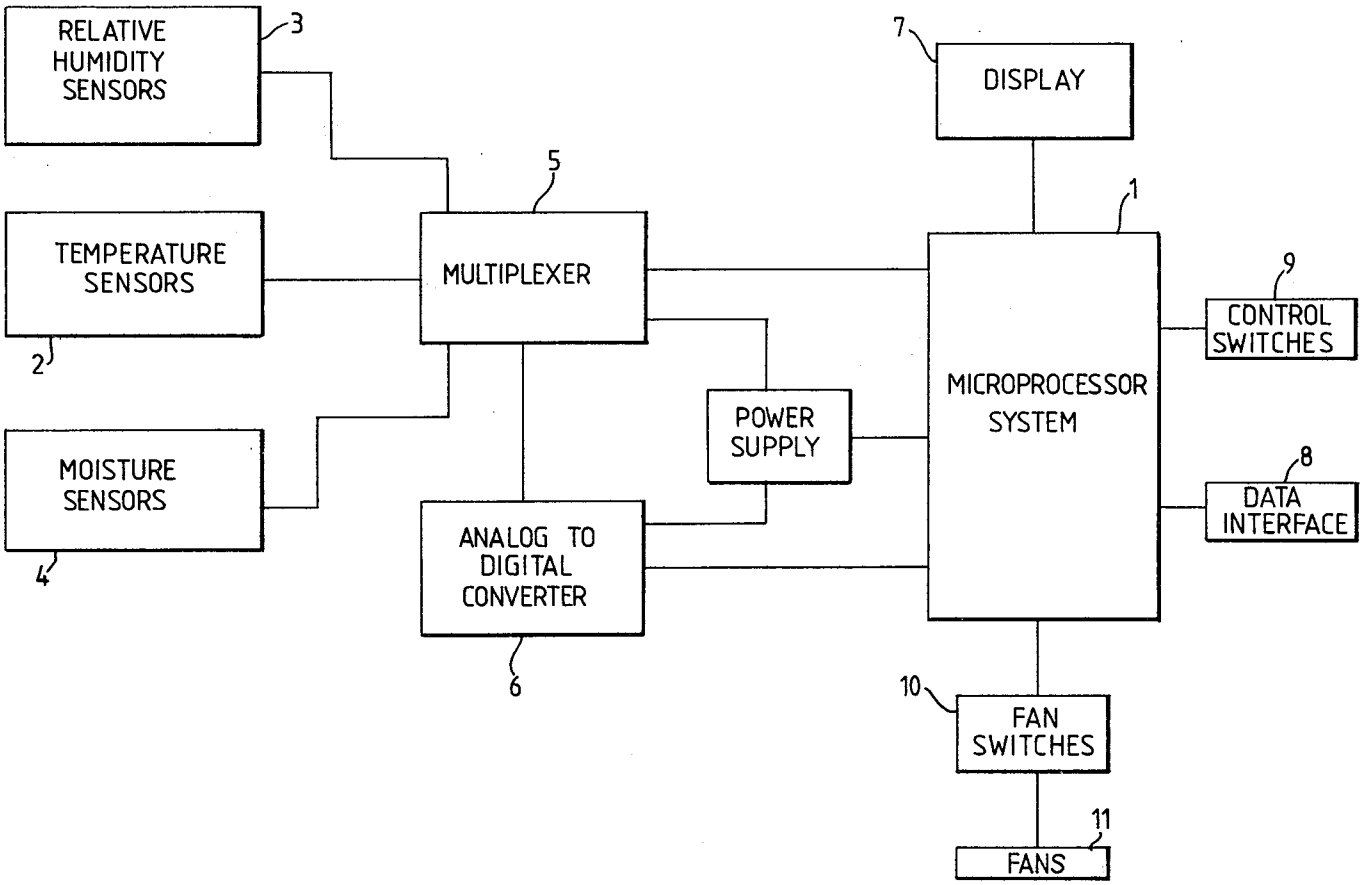
DISPLAY
7
1
MICROPROCESSOR SYSTEM
9
CONTROL SWITCHES
8
DATA INTERFACE
FAN SWITCHES
10
11
FANS
POWER SUPPLY
5
MULTIPLEXER
ANALOG TO DIGITAL CONVERTER
6
3
RELATIVE HUMIDITY SENSORS
TEMPERATURE SENSORS
2
MOISTURE SENSORS
4

IN-STORE DRYING CONTROL METHOD AND SYTEM

The present invention relates to a method and means for controlling the drying of stored products and is particularly but not exclusively suited to use in grain storage.

Various ways have been devised for drying stored products such as beds of rice, wheat, soyabeans and the like; most common methods have included the force feeding of ambient air through the product based on whether the ambient air is at a higher or lower temperature than the stored product within the storage means with a relative humidity over-ride to prevent the use of air which has a relative humidity greater than some set value. Some methods use ambient wet bulb temperature to estimate whether the air will cause cooling to occur.

These methods suffer from over-drying and rewetting of the stored products and can cause undesirable differences in the moisture content of the product at different positions in the storage. Rewetting stored products can cause mechanical stresses to be developed in the walls of the storage means and differences in the moisture content of the product at different locations in the storage can cause problems during storage and in the subsequent processing of the stored product.

The present invention proposes a method and means for controlling the drying and/or aeration of stored products which substantially ameliorates the problems of the known techniques.

In one form the present invention proposes a method of controlling the drying or aeration of a stored product comprising determining the moisture content and temperature of the stored product at various locations, determining the temperature and relative humidity of the air in the storage means in the region near the positions where the air enters and leaves the stored product, determining the temperature and relative humidity of the ambient air external to the storage of the stored product, calculating the effect that feeding the air through the stored product would have on the temperature and moisture content of the product at various positions and on the amount of moisture removed from the total store, then force feeding said ambient air to effect changes in the condition of the stored product if these changes are required.

Various calculations used in controlling the drying include calculating the humidity of the ambient air using the measured temperature and relative humidity of the ambient air, calculating the humidity of the air leaving the stored product using either equilibrium relative values and the measured stored product temperature and moisture content near the position where the air leaves the bed or the measured relative humidity and temperature of the air at this point, calculating the relative humidity that the ambient air would have if its temperature was changed to that of the product in the region near the point where the air enters the stored product and calculating the equilibrium relative humidity at this position in the stored product using the measured stored product temperature and moisture content at this position or alternatively use the measured relative humidity, calculating the humidity of the air surrounding the stored product near the air inlet using the stored product temperature, moisture content and equilibrium relative humidity-equilibrium moisture content relationships.

The difference between the air relative humidity when its temperature is changed to that of the stored product and the equilibrium relative humidity, i.e. the relative humidity of air when the equilibrium with the existing moisture content of the product at the temperature of the product, is indicative of whether force feeding the air through the stored product will cause rewetting or drying in the region near the air inlet. This condition can also be established by considering the difference between the humidity of the ambient air and the humidity of the air surrounding the stored product in the position near the air inlet. The difference between the humidity of the ambient air and the humidity of the air near the position where the air leaves the bed is proportional to the amount of moisture being removed from the bed by the air.

The expression "equilibrium relative humidity" means the relative humidity of the air at a given temperature which corresponds to an equilibrium with the moisture content of the stored product.

In another form the invention provides means for controlling the drying or aeration of a stored product comprising moisture, temperature and relative humidity measuring means adapted to be located in the stored product, temperature and relative humidity measuring means adapted to be located in ambient air external to the storage of stored product, means for calculating the humidity of the air within the store and external to the storage, means for calculating the relative humidity that the ambient air would have if its temperature was changed to that of the stored product, means for determining the equilibrium relative humidity in the stored product and means controlling the operation of ambient air force feeding means to feed ambient air across and/or through the stored product when so doing would cause required changes to the stored product. The calculation of whether or not force feeding air will cause the required changes and what are the required changes is preferably part of the calculating means.

In a particularly preferred form the entire control operation for drying or aeration of stored product is carried out by a programmable microprocessor which continuously monitors the relevant parameters and carries out appropriate control actions for determining the operation or non-operation of forced air drying fans.

Further, the present invention is particularly suited to the controlled drying or aeration of bulk stored agricultural produce such as rice, wheat, barley soyabeans, sunflower seeds and the like. In such uses the temperature and moisture measurements of the stored product, and the temperature and relative humidity measurements of the air in the storage surrounding the product are desirably taken near the positions where the air enters and leaves the bed of product so that the control arrangement is able to avoid running the drying fans when there is no significant moisture removal from the stored product or if running the fans would cause undesirable drying or wetting of the product near the air inlet.

The present invention will now be described by way of example with reference to the accompanying drawing which is a schematic block diagram of a system in accordance with the invention.

In the drawing the storage facility has been omitted in order to simplify understanding of the functioning of the system.

Fans 11 which force ambient air through the stored product are connected with switches 10 operated by signals from microprocessor system 1. The microprocessor system is connected through multiplexer 5 and analogue to digital converter 6 to temperature sensors 2, relative humidity sensors 3 and moisture sensors 4 in the stored product and to temperature sensors 2 and relative humidity sensors 3 located in the ambient air outside the store.

Relative humidity sensors 3 provide electrical signals representative of the relative humidity of the air outside the store and of the air at various positions in the storage means. Temperature sensors 2 provide electrical signals representative of the temperature of the air outside the store and at various positions inside the store and of the product at various positions inside the store. Moisture sensors 4 provide electrical signals representative of the moisture content of the product at various positions inside the store. The respective electrical signals are fed to the multiplexer 5 which is controlled by the microprocessor system 1 to selectively connect the outputs of the sensors and to pass them to the analogue to digital converter 6 which translates the analogue signal to a digital representation.

The output of the converter 6 is passed to the microprocessor system 1 where it is stored. The output can also be passed to display 7 where it can be displayed for the convenience of the operator. Programs in the microprocessor system use the information obtained from the sensors to calculate the changes that would occur to the condition of the stored product if the ambient air at any particular time was to be forced through the store. These calculations include the changes in the temperature and moisture content at various positions in the stored product, the rate at which moisture is removed from the stored product as well as changes in other conditions such as freshness of the stored product. Using data interface 8 or alternatively control switches 9 attached to the microprocessor system the operator specifies the changes that are required to the condition of the stored product. The microprocessor system compares the calculated changes with the specified changes and if forcing the ambient air through the store will cause the condition of the product to move towards the specified objective the microprocessor system sends signals to the fan switches 10 to operate the fans 11.

As conditions in the store and in the ambient air change the microprocessor system continually monitors the operation and if at any time the condition of the stored product moves away from the set objective, signals are sent to the fan switches to switch off the fans. The data interface 8 may also be used to provide a permanent record of the changes in the condition of the stored product.

Various other features which can aid drying may be provided as will be understood by those skilled in the art, particularly where a programmable control means is employed.

We claim:

1. A method of controlling the drying or wetting of a stored agricultural product in a storage means, comprising determining the moisture content and temperature of the stored agricultural product at various locations, determining the temperature and relative humidity of air in the storage means in the regions near where air enters and leaves the stored product, determining the temperature and relative humidity of an ambient air external to the storage means, calculating the effect that feeding the ambient air through the stored product would have on the temperature and moisture content of the product at various positions and on the amount of moisture removed from or added to the total store, then force feeding said ambient air to effect a change in the moisture content of the stored product if such a change is required to thereby maintain predetermined moisture content in the stored agricultural product.

2. A method as claimed in claim 1, wherein the agricultural product is rice, wheat, barley, soyabeans, sunflower seeds or the like.

3. A method as claimed in claim 1, comprising calculating the humidity of the ambient air, calculating the humidity of the air leaving the stored product using either equilibrium relative humidity values and the measured stored product temperature and moisture content near the position where the air leaves the bed or the measured relative humidity and temperature of the air at this point, calculating the relative humidity that the ambient air would have if its temperature was changed to that of the product in the region near the point where the air enters the stored product and calculating the equilibrium relative humidity at this position in the stored product using the measured stored product temperature and moisture content at this position or alternatively using the measured relative humidity, calculating the humidity of the air surrounding the stored product near the air inlet using the stored product temperature, moisture content and equilibrium relative humidity-equilibrium moisture content relationship.

4. A system for controlling the drying or wetting of a stored agricultural product in a storage means, comprising moisture, temperature and relative humidity measuring means located in the stored product, temperature and relative humidity measuring means located in ambient air external to the storage means, means for calculating the humidity of air within the storage means and the humidity of the ambient air, means for calculating the relative humidity that the ambient air would have if its temperature was changed to that of the stored product, means for determining the equilibrium relative humidity in the stored product and means controlling the operation of ambient air force feeding means to feed ambient air across and/or through the stored product when so doing would cause drying or rewetting of the stored product as required in accordance with maintenance of predetermined moisture content for said product.

5. A system for controlling the drying or wetting of a stored agricultural product in a storage means, comprising at least one fan for forcing ambient air through the stored product, switch means controlling the operation of the fan, said switch means being operated by an electrical signal from a microprocessor system, said microprocessor system being connected to relative humidity sensor means, temperature sensor means and moisture sensor means to be located in the stored product and relative humidity and temperature sensor means to be located in ambient air external to the storage means, multiplex and analogue to digital converter means being coupled between said microprocessor system and said sensor means, electrical output signals from said sensor means inputing to the multiplex means which selectively connects the outputs of said sensors to the analogue to digital converter means under the control of the microprocessor system, the output of the analogue to digital convertor means inputing to said microprocessor system, program means in said microprocessor system acting upon said signals from said converter means to control the switch means for the fan so that the fan only runs when the calculated effect on the product shows that the moisture content of the product will be altered to approach a predetermined moisture content for said product.

6. System for controlling the drying or wetting of a stored agricultural product as claimed in claim 5, further comprising a display coupled to the microprocessor system and displaying the output of the converter means.

7. System for controlling the drying or wetting of a stored agricultural product as claimed in claim 5, further comprising a data interface and/or control switch means coupled to the microprocessor system whereby an operator can specify changes in the moisture content that are required to be maintained in the stored product.

8. System for controlling the drying or wetting of a stored agricultural product as claimed in claim 6, further comprising a data interface and/or control switch means coupled to the microprocessor system whereby an operator can specify changes in moisture content that are required to be maintained in the stored product.

* * * * *